US006799999B2

(12) United States Patent
Williamson et al.

(10) Patent No.: US 6,799,999 B2
(45) Date of Patent: Oct. 5, 2004

(54) FILTERED ELECTRICAL CONNECTOR

(75) Inventors: George H. Williamson, Detroit, MI (US); Richard A. Schmidt, Jr., Redford, MI (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/359,843

(22) Filed: Feb. 7, 2003

(65) Prior Publication Data

US 2004/0157494 A1 Aug. 12, 2004

(51) Int. Cl.[7] ..... H01R 24/00
(52) U.S. Cl. ..... 439/676; 439/620
(58) Field of Search ..... 439/188, 352–358, 439/555, 557, 483, 620, 675–676

(56) References Cited

U.S. PATENT DOCUMENTS

| | | | | | |
|---|---|---|---|---|---|
| 5,095,296 | A | | 3/1992 | Parker | 336/92 |
| 5,099,762 | A | * | 3/1992 | Drapala | 102/202.1 |
| 5,280,257 | A | | 1/1994 | Cravens et al. | 333/182 |
| 5,291,829 | A | | 3/1994 | Avory et al. | 102/202.2 |
| 5,309,841 | A | * | 5/1994 | Hartman et al. | 102/202.4 |
| 5,404,263 | A | * | 4/1995 | Graves et al. | 361/247 |
| 5,489,220 | A | | 2/1996 | Hanna et al. | 439/620 |
| 5,630,734 | A | | 5/1997 | Phillips, Jr. | 439/620 |
| 5,697,817 | A | | 12/1997 | Bouchan et al. | 439/676 |
| 5,769,666 | A | | 6/1998 | Wu | 439/620 |
| 5,872,332 | A | | 2/1999 | Verma | 174/35 |
| 5,872,534 | A | | 2/1999 | Mayer | 342/1 |
| 5,896,079 | A | | 4/1999 | Parker | 336/221 |
| 5,900,796 | A | | 5/1999 | Parker | 336/92 |
| 5,957,988 | A | | 9/1999 | Osajda et al. | 701/45 |
| 5,993,230 | A | * | 11/1999 | Gauker et al. | 439/188 |
| 6,073,869 | A | | 6/2000 | Schulz | 242/118.7 |
| 6,152,775 | A | | 11/2000 | Paviovic | 439/620 |
| 6,192,802 | B1 | | 2/2001 | Baginski | 102/202.2 |
| 6,272,965 | B1 | * | 8/2001 | Baginski et al. | 86/1.1 |
| 6,276,953 | B1 | * | 8/2001 | Gauker et al. | 439/352 |
| 6,331,926 | B1 | | 12/2001 | Anthony | 361/56 |
| 6,362,418 | B1 | | 3/2002 | Grandy et al. | 174/36 |
| 2001/0055910 | A1 | | 12/2001 | Olson | 439/620 |

FOREIGN PATENT DOCUMENTS

| | | |
|---|---|---|
| DE | 19611699 C1 | 11/1997 |
| WO | WO-98/02711 | 1/1998 |

* cited by examiner

*Primary Examiner*—J. F. Duverne
(74) *Attorney, Agent, or Firm*—Harrington & Smith, LLP

(57) ABSTRACT

An electrical filter connector assembly including a housing, electrical contact terminals, and a capacitive filter circuit. The housing is sized and shaped to be plugged into a socket of a gas generator. The housing includes at least one contact receiving hole. The electrical contact terminals each have a wire connection section and a female connection section. The terminals are located in the at least one contact receiving hole. The capacitive filter circuit is connected on the wire connection section of a first one of the terminals for providing electromagnetic induction suppression.

33 Claims, 8 Drawing Sheets

FILTERED ELECTRICAL CONNECTOR

BACKGROUND OF THE INVENTION

1. Field of the Invention

The present invention relates to electrical connectors and, more particularly, to filtered electrical connectors.

2. Brief Description of Prior Developments

For a filter connector intended to be used in a small space, such as an air bag connector, increasing the size of the connector is not desired. U.S. Pat. No. 6,152,775, which is hereby incorporated by reference in its entirety, discloses a filtered electrical connector with multiple ferrite members.

Air bag electrical connectors which use ferrite hoods are good for filtering electromagnetic interference around 500 MHz. However, automobiles are now being provided with electronics, such as mobile telephones and Global Positioning System (GPS) devices which can generate electromagnetic interference in the area of about 2–4 GHz. This electromagnetic interference can induce current in conductors leading to an air bag gas generator and cause an accidental discharge of the gas generator. There is a need to provide an air bag connector which can filter electromagnetic interference above 2 GHz and thereby prevent accidental discharge of an air bag gas generator from such interference.

SUMMARY OF THE INVENTION

In accordance with one aspect of the present invention, an electrical filter connector assembly is provided including a housing, electrical contact terminals, and a capacitive filter circuit. The housing is sized and shaped to be plugged into a socket of a gas generator. The housing includes at least one contact receiving hole. The electrical contact terminals each have a wire connection section and a female connection section. The terminals are located in the at least one contact receiving hole. The capacitive filter circuit is connected on the wire connection section of a first one of the terminals for providing electromagnetic induction suppression.

In accordance with another aspect of the present invention, an electrical filter connector assembly is provided comprising a housing, electrical contact terminals, and a filter assembly. The housing is sized and shaped to be plugged into a socket of a gas generator. The housing comprising at least one contact receiving hole. The electrical contact terminals each have a wire connection section and a female connection section. The terminals are located in the at least one contact receiving hole. The filter assembly comprises a printed circuit board, a filter circuit on the printed circuit board, and leads connecting the printed circuit board to a first one of the terminals to thereby connect the filter circuit to the first terminal.

In accordance with one method of the present invention, a method of assembling an air bag electrical connector is provided comprising steps of providing a housing having a socket insertion end which is sized and shaped to be inserted into a socket of a gas generator; connecting an electrical contact terminal to an electrical wire at a wire connection section of the terminal; connecting a capacitive filter assembly to the terminal; and inserting the terminal and the capacitive filter assembly into the housing.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
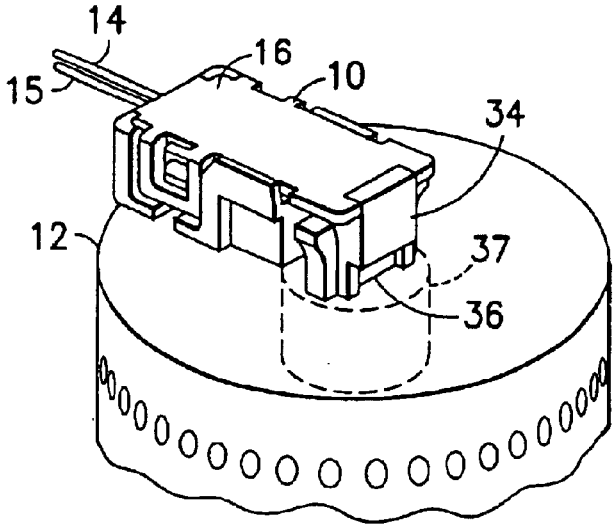
FIG. 1 is a perspective view of an electrical connector incorporating features of the present invention attached to an air bag gas generator.

Referring to FIG. 1, there is shown a perspective view of an exemplary electrical connector 10, incorporating features of the present invention, shown attached to an air bag gas generator 12. In alternate embodiments, the connector 10 could be attached to any suitable type of gas generator or, to any other type of electrical or electronic component. Although the present invention will be described with reference to the exemplary embodiment shown in the drawings, it should be understood that the present invention can be embodied in many alternate forms of embodiments. In addition, any suitable size, shape or type of elements or materials could be used.

Figure 3:
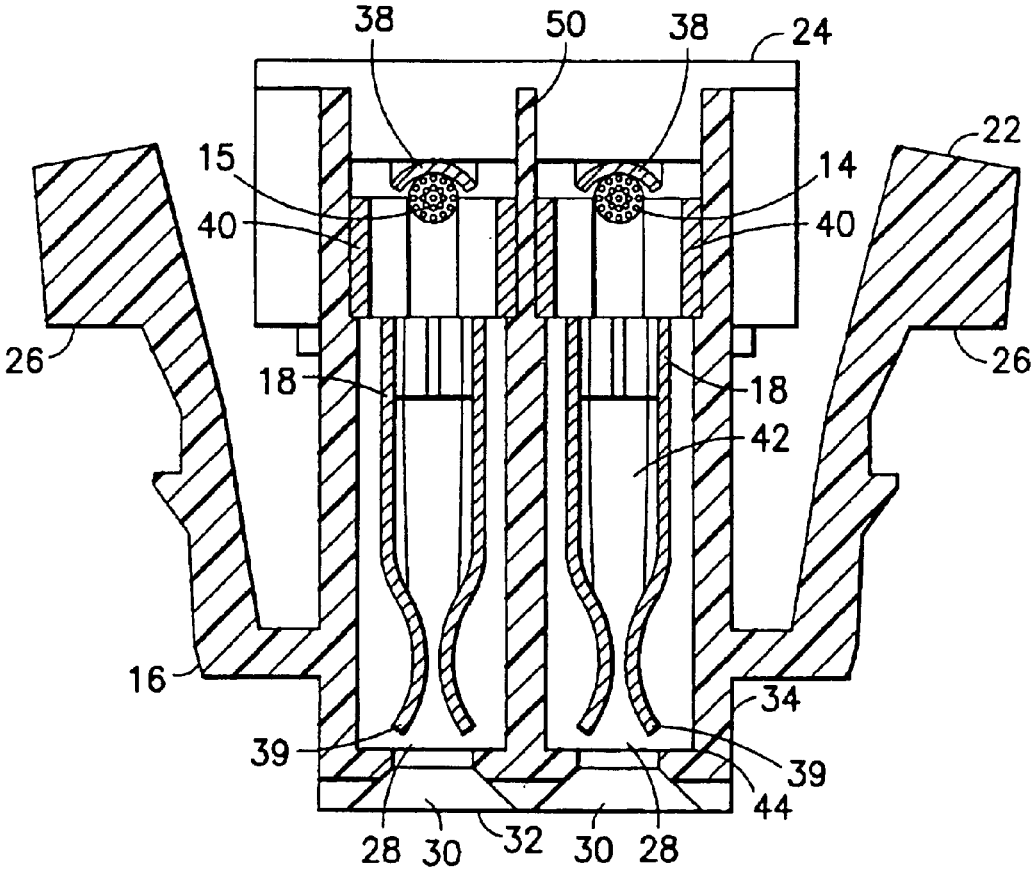
FIG. 3 is a cross-sectional view of the electrical connector shown in FIG. 1.
Figure 2:
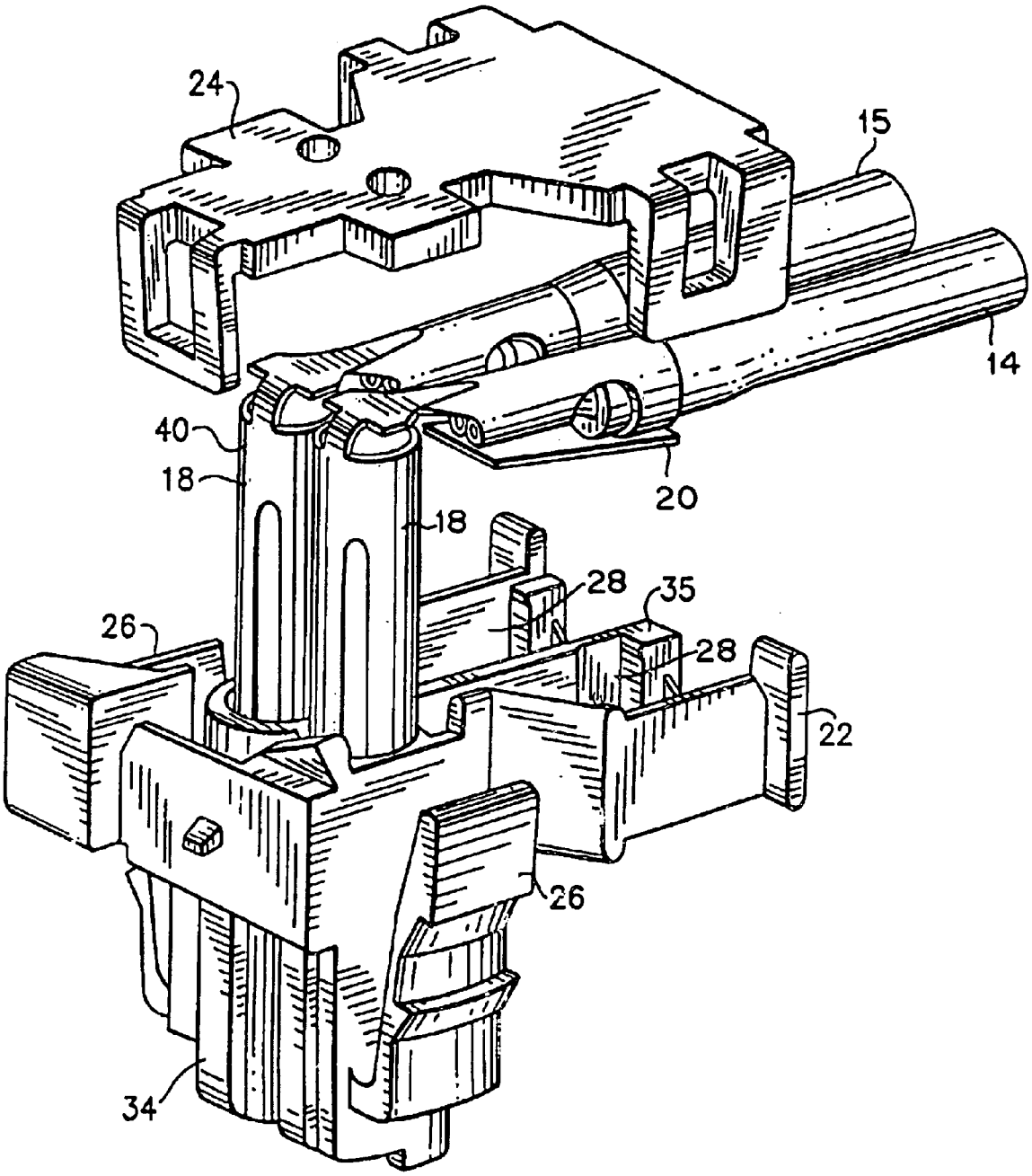
FIG. 2 is an exploded perspective view of the electrical connector shown in FIG. 1.

The connector 10, in this embodiment, is for use in connecting electrical conductors 14, 15 with an initiator 37 in the air bag gas generator 12. Referring also to FIGS. 2 and 3, the connector 10 generally comprises a housing 16, electrical contact terminals 18 and a filter assembly 20 (see FIG. 2). The connector 10 does not include prior art ferrite hoods or tubes. Instead, the connector comprises the filter assembly 20 which is intended to replace the ferrite hoods. However, in alternate embodiments, the connector could additionally comprise one or more ferrite hoods to provide additional filtering.

Unlike a conventional air bag connector having ferrite hoods which are good at filtering electromagnetic induction interference at 500 MHz and below, the connector 10 uses the filter assembly 20 to filter electromagnetic interference (EMI), which could otherwise cause an induction current, in the range below 2–4 GHz. In one exemplary embodiment, the filter assembly has been used to filter electromagnetic interference in the range of about 6 GHz and below. Features of the present invention are intended to prevent an EMI discharge at an air bag gas generator by filtering electromagnetic induction current in the electrical connector used to connect electrical wires to the gas generator. Features of the present invention can provide an enhanced EMI suppression capability.

The housing 16 comprises a first housing piece 22 and a second housing piece 24. The two housing pieces are preferably comprised of molded plastic or polymer material. However, in alternate embodiments, any suitable material(s) could be used. In an alternate embodiment, the housing could be comprised of more or less than two housing pieces.

The first housing piece 22 includes two cantilevered finger actuatable deflectable latches 26, two separate receiving areas 28, and two holes 30 through a bottom face 32 of the housing into the receiving areas 28. However, in alternate embodiments, the latches 26 might not be provided. Alternatively, any suitable type of latching system could be provided. The housing 16, at the bottom of the front section 34, is adapted to be plugged into a socket 36 of the initiator 37 of the gas generator 12. The latches 26 are adapted to latch with latch surfaces in the socket 36. Optionally, additional connector position assurance means (not shown) can be provided to prevent the connector 10 from accidentally being disengaged from the gas generator 12. The second housing piece 24 is preferably snap lock mounted onto the first housing piece 22 after the contacts 18 and filter assembly 20 are located in the receiving areas 28. However, in alternate embodiments, any suitable type of connection could be provided. In addition, in alternate embodiments, other types of housings or housing components could be provided.

Figure 4:
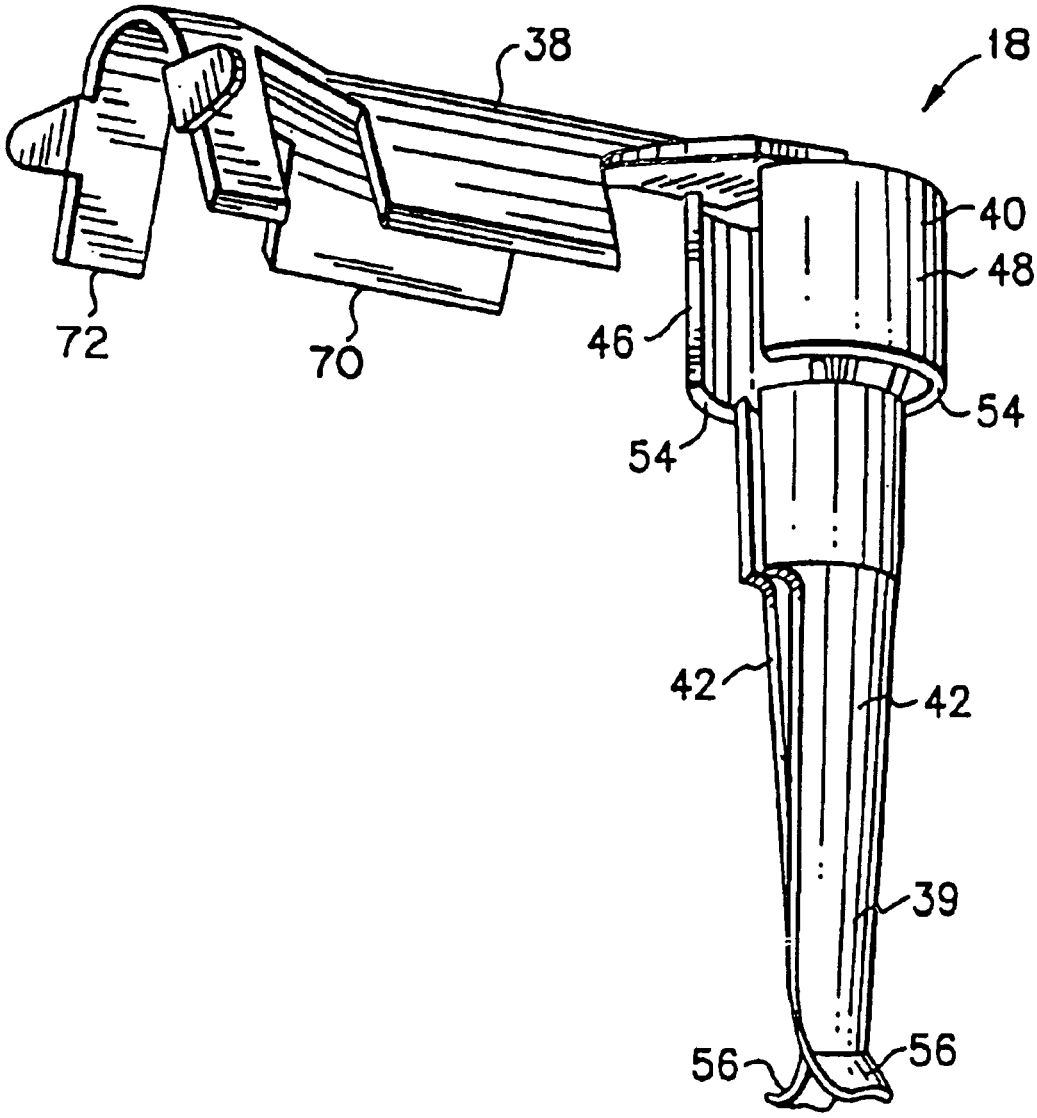
FIG. 4 is a perspective view of one of the electrical contact terminals shown in FIGS. 2 and 3.

Referring also to FIG. 4, the electrical contact terminals 18 each comprise a first connection section 38, a second female connection section 39, and a positioning section 40. Each first connection section 38 forms a wire connection section for one of the wires 14, 15. However, in alternate embodiments, the terminals 18 could comprise additional sections or sections which are shaped differently from the shapes shown in the drawings. Preferably, the contact terminals 18 are comprised of stamped and formed sheet metal. However, in alternate embodiments, the contact terminals could be comprised of any suitable material(s) and/or could be formed by any suitable contact manufacturing process.

Referring now particularly to FIGS. 2, 5, 6 and 7, the connector 10 comprises a single filter assembly 20. However, in alternate embodiments, the connector could comprise more than a single filter assembly. The filter assembly 20 generally comprises a printed circuit board 78, a filter circuit 80, connector leads 82, 83, and an insulative sheet or coating 84. The filter circuit 80 preferably comprises a plurality of capacitors.

Figure 11:
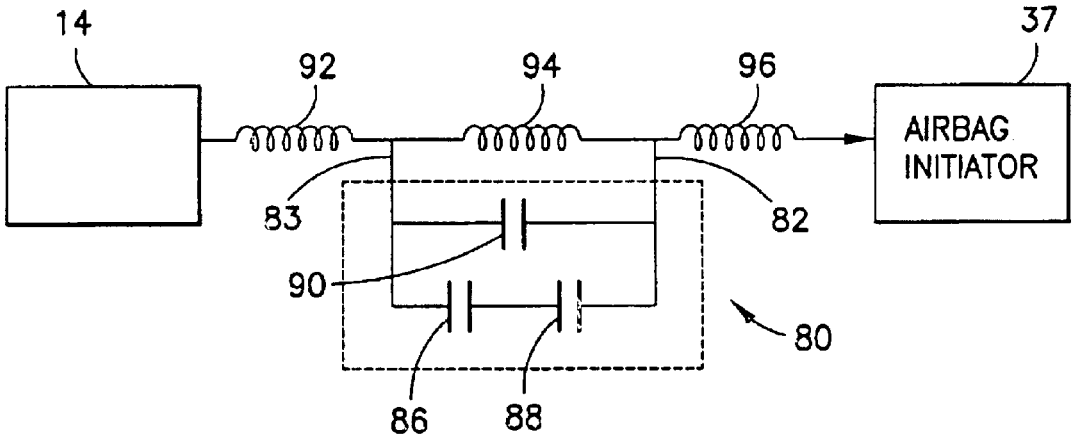
FIG. 11 is a diagrammatic circuit diagram showing the filter circuit of the filter assembly and how it affects induction in one of the terminals.

Referring also to FIG. 11, in a preferred embodiment the filter circuit 80 comprises two groups of capacitors. The first group of capacitors comprises two capacitors 86, 88 connected in series. The second group of capacitors comprises a capacitor 90. The first group of capacitors is connected in parallel with the second group of capacitors. However, in alternate embodiments, the filter circuit 80 could comprise more or less capacitors and the capacitors could be arranged in any suitable type of circuit configuration.

The filter circuit 80 is fixedly attached to the printed circuit board 78. The connector leads 82, 83 extend from the printed circuit board 78 and are attached to the wire connection section 38 of the terminal 18 which is attached to the wire 14. More specifically, in the embodiment shown, the first connector lead 82 is attached to the front of the front portion 70 of the wire connection section 38. The second connector lead to 83 is attached to the rear portion 72 of the wire connection section 38. The connector leads 82, 83 could be solder reflow connected to the terminal 18.

In alternate embodiments, any suitable type of system for connecting the printed circuit board to the terminal could be provided. For example, the leads 82, 83 could be connected to any suitable locations on the terminal 18. Some alternative are described with reference to FIGS. 13–15 below. However, the housing must have a receiving area to receive and house the filter circuit 80 in order to retain the filter circuit with the connector; as part of the connector.

Figure 7:
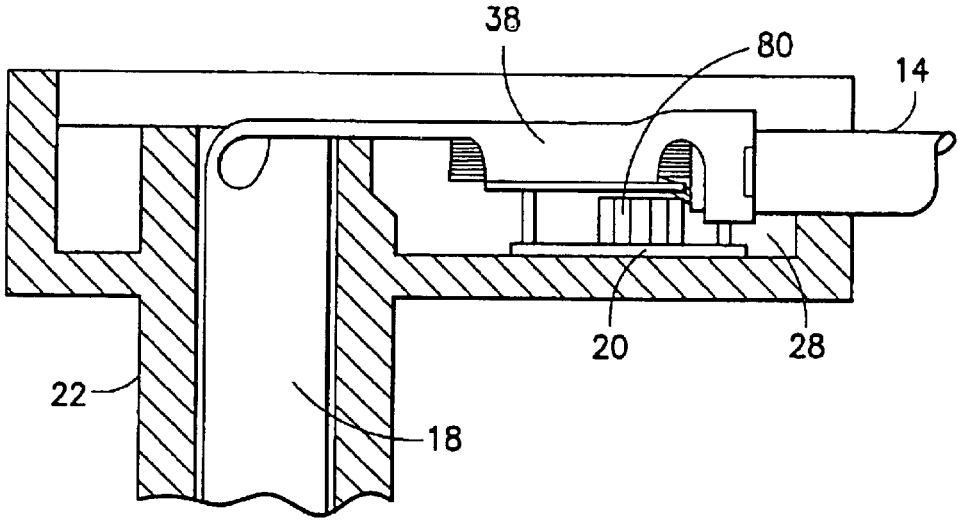
FIG. 7 is a partial cross sectional view of the components shown in FIG. 6 inside a housing piece of the connector shown in FIG. 1.

The filter circuit receiving area can be at any suitable location inside the housing 16. However, it has been found that locating the filter circuit receiving area at the area of the housing which receives the wire connection section of the terminal 18 provides the most efficient location for locating the filter circuit 80 without significantly increasing the size of the connector. This also provides a good area on the contact 18 to connect the filter circuit 80 (i.e., at the elongate wire connection section). In the embodiment shown, the filter assembly 20 is attached to the bottom side of the wire connection section 38. As seen in FIG. 7 the receiving area 28 of the housing 16 is sufficiently large enough to accommodate location of the filter assembly 20 therein.

In the past, filter circuits were provided in gas generators. However, when this type of gas generator was used, the filter circuit was discarded after use. With the present invention, by providing the filter circuit 80 in the connector 10, rather than the in the gas generator or the gas generator's initiator, the filter circuit does not need to be discarded after the initiator is used. The connector 10 and its filter circuit can be used with a new replacement gas generator and initiator. This can save costs because the gas generator and/or its initiator can be manufactured without it's own filter circuit, and capacitive filtering can still be provided; inside the connector rather than inside the gas generator initiator. The snap-lock assembly of the housing pieces 22, 24 can also allow the housing to be opened and the filter circuit 80 tested and/or repaired or replaced if desired.

Figure 10:
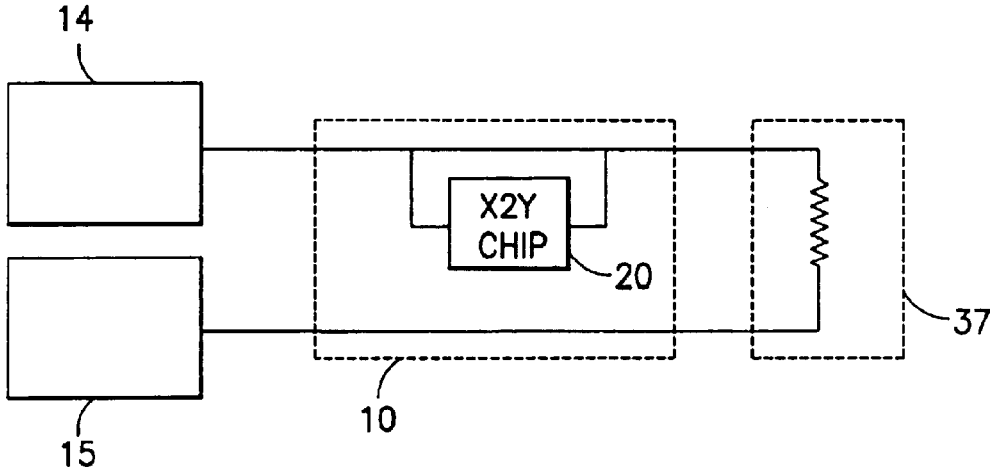
FIG. 10 is a circuit diagram of the connector shown in FIG. 2 attached to a gas generator initiator.

The insulative sheet or coating 84 is located between the filter circuit 80 and the wire connection section 38. This helps to electrically insulating the filter circuit 80 from the contact 18 except through the circuit path provided by the printed circuit board 78 and connector leads 82, 83. Referring also to FIG. 10, the electrical connector 10 provides a connection between the wires 14, 15 and the gas generator initiator 37. The filter assembly 20 is connected to the electrical path between the wire 14 and the initiator 37.

Figure 12:
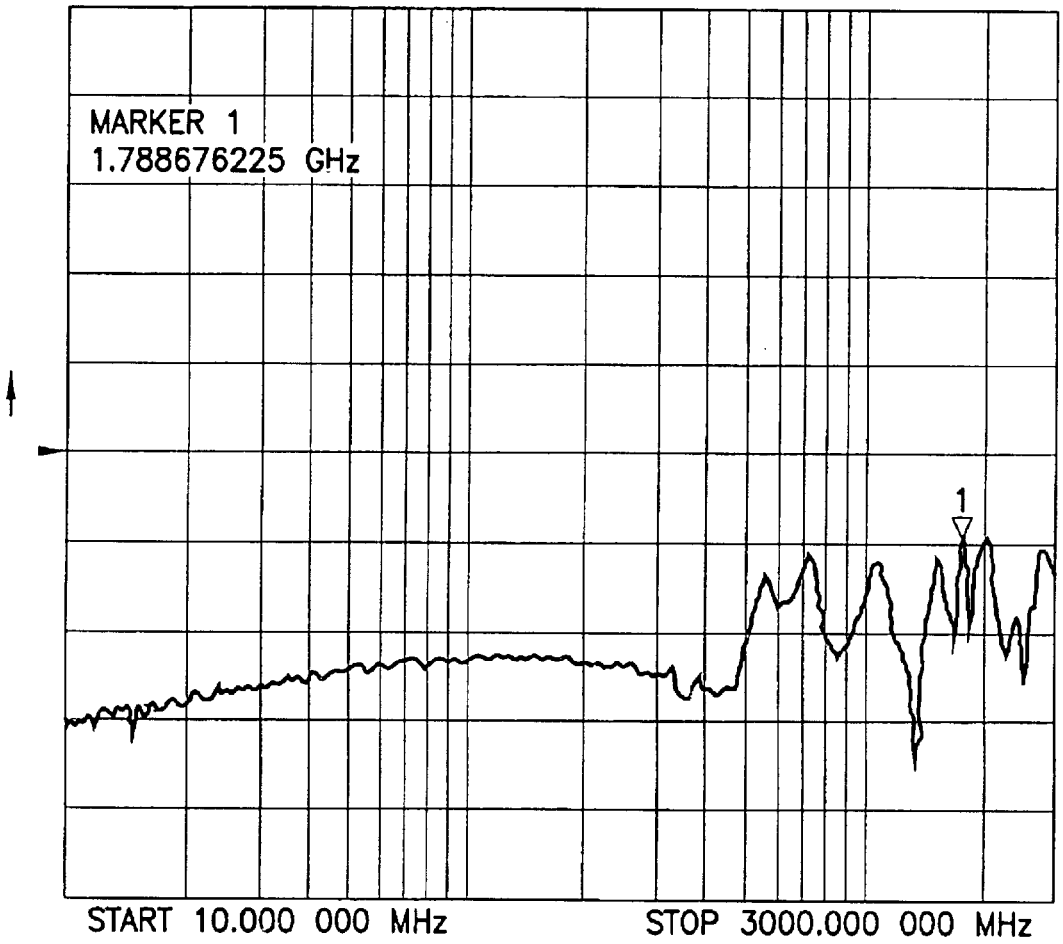
FIG. 12 is a chart showing electromagnetic interference in a terminal.

Referring also to FIG. 11, the electrical path between the wire 14 and the air bag initiators 37 is susceptible to electromagnetic inductions 92, 94, 96. The filter circuit 80 is connected by the connector leads 82, 83 at the front and rear of one of the induction area 94. The filter circuit 80 helps to suppress an induction current between the wire 14 and the air bag initiator 37. This helps to suppress an accidental initiation of the initiator 37 from electromagnetic interference. Referring also to FIG. 12, there is shown a chart showing electromagnetic interference along one of the terminals without the filter assembly 20. As can be seen, there can be substantial, electromagnetic interference between 400 MHz and 3 GHz. The filter assembly 20 can be used to reduce this interference.

Referring back to FIG. 4, the first connection section 38 is provided for forming a wire connection section or lead section for the contact terminal 18. The first connection sections 38 can be crimped onto respective ones of the electrical conductors 14, 15 for connecting the electrical conductors 14, 15 to the contact terminal 18. The wire connection section 38 includes a front portion 70 and a rear portion 72. The front portion 70 is crimped onto the conductor strands 74 of the wire 14 or 15 (see FIG. 6). The rear portion 72 is crimped onto the outer electrical insulation 76 of the wire 14 or 15 (see FIG. 6). However, in alternate embodiments, the first connection section 38 could have any suitable shape. The conductors 14, 15 could be crimped, soldered or welded to the first connection section 38. In the embodiment shown, the first connection section 38 is angled about 90° relative to the second connection section 39. However, the lead section could be straight for an in-line connector.

The positioning section 40 is located between the first connection section 38 and the second connection section 39. In the embodiment shown, the positioning section 40 generally comprises a main shaft section 44 (see FIG. 5), two cantilevered arms 46, 48, and the contact arms 42 can also help to position the contact in the housing. In an alternate embodiment, the positioning section could comprise additional or alternative sections. For example, the positioning section 40 could comprise more or less than two cantilevered arms. As another example, the cantilevered arm(s) could be cantilevered in a downward direction rather than a lateral direction from the main shaft section.

Figure 5:
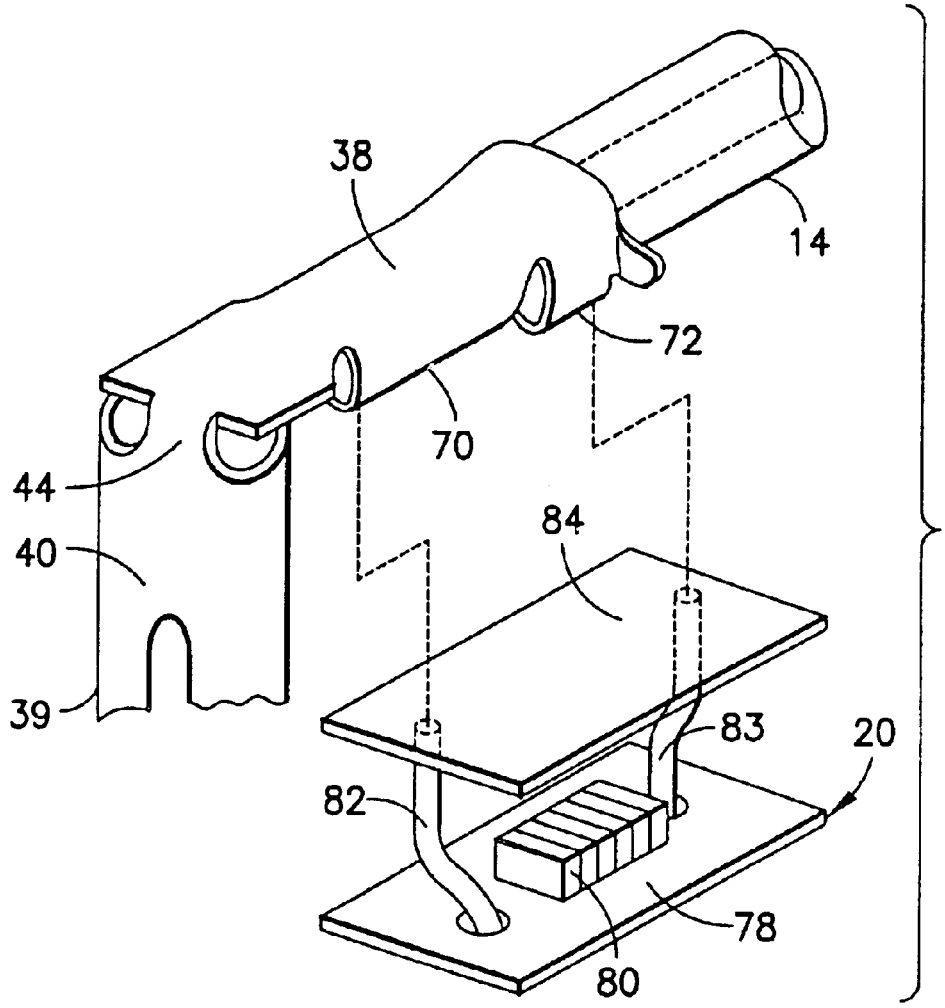
FIG. 5 is a partial and exploded perspective view of one of the terminals, the filter assembly, and one of the wires shown in FIG. 2.
Figure 6:
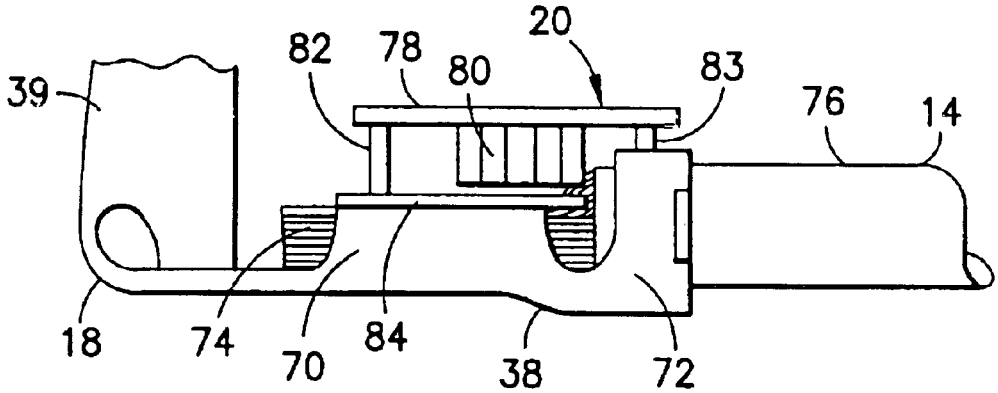
FIG. 6 is a partial side elevational view of the components shown in FIG. 5.

As seen in FIG. 5, the main shaft section 44 connects the first connection section 38 to the second connection section 39. The two cantilevered arms 46, 48 extend from opposite sides of the main shaft section 44. In the embodiment shown, the two cantilevered arms 46, 48 are substantially mirror images of each other. However, in alternate embodiments, the two cantilevered arms could comprise different sizes and shapes. Each cantilevered arm comprises a general curved shape. The cantilevered arms 46, 48 extend outwardly from the main shaft section 44 and curved inwardly towards each other. This forms the positioning section 40 with a general tubular shape. However, in alternate embodiments, the positioning section 40 could comprise any suitable type of shape.

The positioning section 40 is sized and shaped to be received in the upper part of one of the receiving areas 28. The outer surfaces of the cantilevered arms 46, 48 make a direct physical contact with the inner walls of the first housing piece 22 in the upper part of the receiving area 28. In a preferred embodiment, the positioning section 40 has its outer surfaces of the cantilevered arms 46, 48 make a mating friction fit engagement with the inner walls of the receiving area 28. If desired, when the cantilevered arms 46, 48 are inserted into the receiving area 28, they can resiliently deflect inward to form a press fit mating of the positioning section 40 with the first housing piece 22.

The cantilevered arms 46, 48 have a height which allows the positioning section 40 to center the positioning section 40 and second connection section 39 in the receiving area 28. The cantilevered arms 46, 48 form an outer perimeter which is larger than the outer perimeter of the second connection section 39. The cantilevered arms 46, 48 form contact surfaces 54 on their bottom edges. The contact surfaces 54 are located laterally outward past the outer sides of the second connection section 39.

In the embodiment shown, the second female connection section 39 generally comprises two spring contact arms 42. However, in alternate embodiments, the second female connection section could comprise more than two spring contact arms or, alternatively, could comprise any suitable type of female shaped connection section. The two spring contact arms 42 extend in a general cantilever fashion from the main shaft section 44 of the positioning section 40. In the embodiment shown, each spring contact arms 42 comprises a general curved cross-section and are substantially mirror images of each other. Thus, the second connection section 39 forms a general column shape. However, in alternate embodiments, the contact arms could have different shapes and/or could be different from each other.

In the embodiment shown, the general tubular shape of the positioning section 40 is coaxially aligned with the center axis of the second connection section 39. However, in alternate embodiments, the positioning section and the second connection section need not be coaxially aligned. The two spring contact arms 42 taper towards each other towards their distal ends 56. The distal ends 56 flair outward to form a male contact entrance area 58. However, as noted above, in alternate embodiments the spring contact arms could comprise any suitable type of shape.

In the embodiment shown, the two receiving areas 28 are separated by a wall 50 of the housing 16. As seen best in FIG. 3, the housing 16 and the terminals 18 are preferably sized and shaped to provide a gap between the second female connection sections 39 of the terminals 18 and the side walls inside the receiving areas 28 of the housing 16. This allows for a limited amount of lateral movement or lateral rocking of the second female connection sections 39 in the receiving areas 28. However, the housing 16 and terminals 18 preferably do not allow forward or rearward movement of the second female connection sections 39 in the receiving areas 28.

Figure 8:
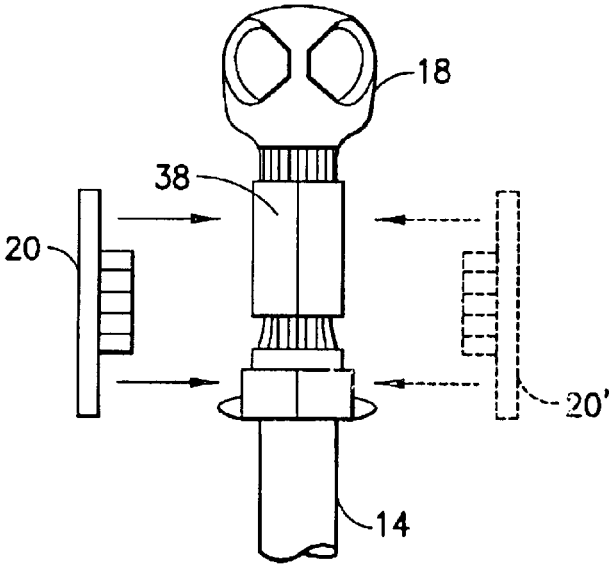
FIG. 8 is a bottom plan view of the terminal and wire assembly shown in FIGS. 5–6 showing alternate locations for attaching the filter assembly.
Figure 9:
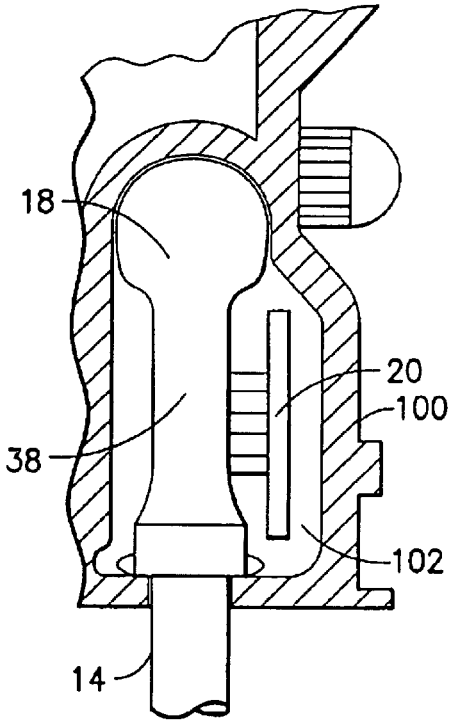
FIG. 9 is a partial cross sectional view of the terminal and wire assembly and the filter assembly shown in FIG. 8 located inside a connector housing piece.

Referring also to FIGS. 8 and 9, there is shown an alternate embodiment of the present invention. The filter assembly 20 could be mounted to the right lateral side of the terminal 18. The housing 100 could accommodate an enlarged open area 102 to receive the laterally projecting filter assembly 20. This type of configuration can help to minimize the height of the housing at the wire connection section 38. Also as seen in dotted lines in FIG. 8, the filter assembly 20 could alternatively be mounted to the left lateral side of the terminal 18. In other alternate embodiments, the filter assembly could be mounted to the terminal 18 in any suitable position or location. In one type of alternate embodiment, the printed circuit board could be located between the filter circuit 80 and the terminal 18. Thus, the insulation 84 might not be needed.

The socket 36 of the initiator 37 of the gas generator 12 shown in FIG. 1 has two male pin contacts (not shown) at a fixed spacing relative to each other that are received in the two female connection sections 39 through the holes 30 in the housing 12. Thus, the contact terminals 18 are able to electrically connect the male pin contacts (not shown) to the conductors 14, 15.

When the contact terminals 18 are connected to the conductors 14, 15, the filter assembly 20 placed on one of the contact terminals 18, and the filter assembly and terminals placed in the first housing piece 22, the second housing piece 24 is then snap lock mounted onto the first housing piece 22 to capture the terminals and filter assembly in place at a fixed relationship to each other. The first and second housing pieces 22, 24 also provide strain relief for the conductors 14, 15 at the rear section 35. In an alternate embodiment the strain relief might not be provided, or could be provided by an over-molded third housing piece (not shown) or any other suitable means.

Figure 13:
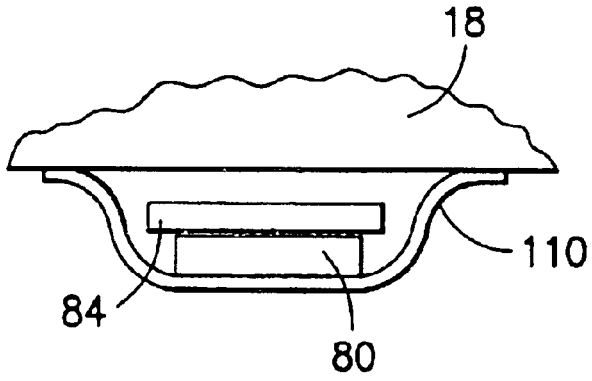
FIG. 13 is a diagrammatic view of an alternate embodiment of a connection between the filter circuit and the connector terminal.

Referring now to FIG. 13, there is shown an alternate embodiment of the present invention. In this embodiment the air bag electrical connector comprises the filter circuit 80 connected to the terminal 18 by a flex circuit 110, such as a flexible flat conductor cable (FFC) or flexible printed circuit cable (FPC). This embodiment also has the insulator 84. However, in an alternate embodiment the insulator 84 might not be provided.

Figure 14:
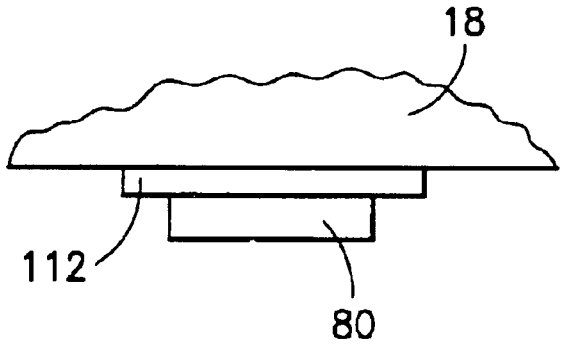
FIG. 14 is a diagrammatic view of another alternate embodiment of a connection between the filter circuit and the connector terminal.

Referring to FIG. 14, there is shown another alternate embodiment of the present invention. In this embodiment the air bag electrical connector comprises the filter circuit 80 connected to the terminal 18 by a conductive coating 112.

Figure 15:
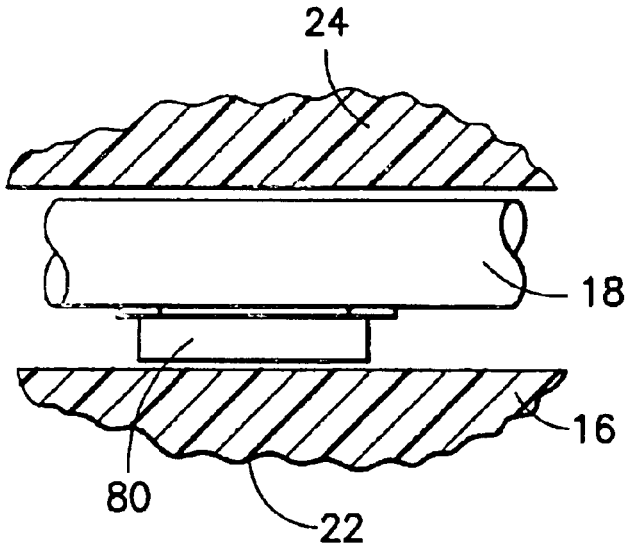
FIG. 15 is a diagrammatic view of another alternate embodiment of a connection between the filter circuit and the connector terminal.

Referring to FIG. 15, there is shown another alternate embodiment of the present invention. In this embodiment the air bag electrical connector comprises the filter circuit 80 connected to the terminal 18 by physical presence or pressure by the housing 16. The terminal 18 and filter circuit 80 are sandwiched or clamped between the two housing pieces 22, 24. The housing 16 provides a biasing force to keep the filter circuit 80 in electrical connection with the terminal 18. In an alternate embodiment, the connector could comprise an additional biasing member, such as a spring or a spring contact (not shown) biasing the circuit 80 against the terminal 18 or connecting contacts (not shown) to electrically connect the filter circuit 80 to the terminal 18.

It should be understood that the foregoing description is only illustrative of the invention. Various alternatives and modifications can be devised by those skilled in the art without departing from the invention. Accordingly, the present invention is intended to embrace all such alternative, modifications and variances which fall within the scope of the appended claims.

What is claimed is:

1. An electrical filter connector assembly comprising:

a housing which is sized and shaped to be plugged into a mating electrical connector socket of an initiator of a gas generator, the housing comprising at least one mating electrical connector contact receiving hole adapted to receive an electrical contact of the mating electrical connector socket;

electrical contact terminals, each terminal having a wire connection section and a mating electrical connector connection section, a first one of the terminals being located in the at least one contact receiving hole, wherein the mating electrical connector connection section of the first electrical contact terminal is adapted to receive one of the electrical contacts of the mating electrical connector socket; and a capacitive filter circuit connected on the wire connection section of the first terminal for providing electromagnetic induction suppression.

2. An electrical filter connector assembly as in claim 1 further comprising a printed circuit board having the capacitive filter circuit thereon, wherein the printed circuit board is connected to the first terminal by electrical leads.

3. An electrical filter connector assembly as in claim 1 wherein the capacitive filter circuit comprises multiple capacitors.

4. An electrical filter connector assembly as in claim 3 wherein the capacitive filter circuit comprises two groups of capacitors connected in parallel, and wherein one of the groups of capacitors comprises two capacitors connected in series.

5. An electrical filter connector assembly as in claim 1 further comprising an electrically insulating sheet or coating located between the capacitive filter circuit and the first terminal.

6. An electrical filter connector assembly as in claim 1 wherein the capacitive filter circuit is located on a lateral side of the wire connection section.

7. An electrical filter connector assembly comprising:

a housing which is sized and shaped to be plugged into a mating electrical connector socket of a gas generator, the housing comprising at least one contact receiving hole;

electrical contact terminals, each terminal having a wire connection section and a female connection section, the terminals being located in the at least one mating electrical connector contact receiving hole and adapted to receive electrical contacts of the mating electrical connector socket; and a filter assembly comprising a printed circuit board, a filter circuit on the printed circuit board, and leads connecting the printed circuit board to a first one of the terminals to thereby connect the filter circuit to the first terminal.

8. An electrical filter connector assembly as in claim 7 wherein the filter circuit comprises a capacitor.

9. An electrical filter connector assembly as in claim 7 wherein the capacitive filter circuit comprises multiple capacitors.

10. An electrical filter connector assembly as in claim 9 wherein the capacitive filter circuit comprises two groups of capacitors connected in parallel, and wherein one of the groups of capacitors comprises two capacitors connected in series.

11. An electrical filter connector assembly as in claim 7 further comprising an electrically insulating sheet or coating located between the filter circuit and the first terminal.

12. An electrical filter connector assembly as in claim 7 wherein the filter circuit is located on a lateral side of the wire connection section.

13. An electrical filter connector assembly as in claim 7 wherein the leads are connected to the wire connection section of the first terminal.

14. A method of assembling an air bag electrical connector comprising steps of:

providing a housing having a socket insertion end which is sized and shaped to be inserted into a mating electrical connector socket of a gas generator, wherein the housing comprises a first contact receiving area adapted to receive an electrical contact of the mating electrical connector;

connecting an electrical contact terminal to an electrical wire at a wire connection section of the terminal;

connecting a capacitive filter assembly to the terminal; and inserting the terminal and the capacitive filter assembly into the housing, wherein the terminal is located in the contact receiving area of the housing for making contact with the electrical contact of the mating electrical connector socket.

15. A method as in claim 14 wherein the step of connecting the capacitive filter assembly to the terminal comprises connecting leads to the wire connection section of the terminal.

16. A method as in claim 14 wherein the capacitive filter assembly comprises a capacitor circuit mounted on a printed circuit board, and wherein the step of connecting the capacitive filter assembly to the terminal comprises locating the capacitive filter assembly alongside the wire connection section.

17. A method of assembling an air bag electrical connector comprising steps of:

providing a housing having a socket insertion end which is sized and shaped to be inserted into a socket of a gas generator;

connecting an electrical contact terminal to an electrical wire at a wire connection section of the terminal;

connecting a capacitive filter assembly to the terminal; and inserting the terminal and the capacitive filter assembly into the housing wherein the capacitive filter assembly comprises a capacitor circuit mounted on a printed circuit board, and wherein the step of connecting the capacitive filter assembly to the terminal comprises locating the capacitive filter assembly alongside the wire connection section, and wherein the step of connecting the capacitive filter assembly to the terminal comprises locating an electrically insulative sheet or coating between the wire connection section and the capacitor circuit.

18. A method as in claim 14 further comprising providing capacitive filter assembly with a capacitive filter circuit having two groups of capacitors connected in parallel, and wherein one of the, groups of capacitors comprises two capacitors connected in series.

19. An electrical filter connector assembly as in claim 1 the capacitive filter circuit has two leads which are connected to only the first electrical contact terminal.

20. An electrical filter connector assembly as in claim 1 wherein the capacitive filter circuit is adapted to filter electromagnetic interference in a range of about 6 GHz and below.

21. An electrical filter connector assembly as in claim 1 wherein the capacitive filter circuit is adapted to filter electromagnetic interference in a range of about 2–4 GHz and below.

22. An electrical filter connector assembly as in claim 7 wherein the leads are directly connected to only the first terminal.

23. An electrical filter connector assembly as in claim 7 wherein the filter assembly is adapted to filter electromagnetic interference in a range of about 6 GHz and below.

24. An electrical filter connector assembly as in claim 7 wherein the filter assembly is adapted to filter electromagnetic interference in a range of about 2–4 GHz and below.

25. An electrical filter connector assembly comprising:

a housing;

at least two electrical contact terminals on the housing; and a first capacitive filter circuit connected to a first one of the electrical contact terminals for providing electromagnetic induction suppression, wherein the first capacitive filter circuit comprises a plurality of capacitors, wherein the first capacitive filter circuit is connected to a first side of the first electrical contact terminal, and wherein the first capacitive filter circuit is not directly connected to a second one of the electrical contact terminals, such that the first capacitive filter circuit makes direct electrical connection with only the first one of the electrical contact terminals.

26. An electrical filter connector assembly as in claim 25 wherein the first side is a lateral side of the first electrical contact terminal.

27. An electrical filter connector assembly as in claim 25 wherein the first side is a bottom side of the first electrical contact terminal.

28. An electrical filter connector assembly as in claim 25 wherein the capacitive filter circuit comprises two leads attached to the first side of the first electrical contact terminal.

29. An electrical filter connector assembly as in claim 25 wherein the capacitive filter circuit comprises a general block shaped member attached to the first side of the first electrical contact terminal.

30. An electrical filter connector assembly as in claim 25 wherein the capacitive filter circuit comprises is attached to the first electrical contact terminal at only the first side.

31. An electrical filter connector assembly comprising:

a housing;

at least two electrical contact terminals on the housing; and a first capacitive filter circuit electrically coupled to a first one of the electrical contact terminals for providing electromagnetic induction suppression, wherein the first capacitive filter circuit is electrically coupled to only the first electrical contact terminal and is not directly coupled to a second one of the electrical contact terminals.

32. An electrical filter connector assembly as in claim 31 wherein the electrical filter connector assembly comprises an air bag electrical filter connector assembly and the housing is sized and shaped to be inserted into a receiving soket of a gas generator initiator.

33. An electrical filter connector assembly as in claim 31 further comprising a second capacitive filter circuit electrically coupled to a second one of the electrical contact terminals for providing electromagnetic induction suppression, wherein the second capacitive filter circuit is electrically coupled to only the second electrical contact terminal and is not directly coupled to the first electrical contact terminal.

* * * * *